US009033606B2

(12) United States Patent
Turchi et al.

(10) Patent No.: US 9,033,606 B2
(45) Date of Patent: May 19, 2015

(54) DOSING AND DISPENSING DEVICE FOR LIQUID LAUNDRY DETERGENT

(75) Inventors: Mario Alexander Turchi, Edgewater, NJ (US); Josh Hartl, Edgewater, NJ (US); Robert Joachim, Edgewater, NJ (US); Steve Madsen, Edgewater, NJ (US)

(73) Assignee: Reckitt Benckiser, WT Hoofddorp (NL)

( * ) Notice: Subject to any disclaimer, the term of this patent is extended or adjusted under 35 U.S.C. 154(b) by 679 days.

(21) Appl. No.: 13/370,366

(22) Filed: Feb. 10, 2012

(65) Prior Publication Data

US 2012/0263516 A1 Oct. 18, 2012

Related U.S. Application Data

(60) Provisional application No. 61/476,011, filed on Apr. 15, 2011.

(51) Int. Cl.
*D06F 39/02* (2006.01)
*A47L 13/12* (2006.01)

(52) U.S. Cl.
CPC ..... *D06F 39/024* (2013.01); *A47L 13/12* (2013.01)

(58) Field of Classification Search
USPC ..... 401/261, 263, 264, 265; 68/17 R, 17 A, 68/235 R; 8/137, 158; 206/77.1
See application file for complete search history.

(56) References Cited

U.S. PATENT DOCUMENTS

| | | | | |
|---|---|---|---|---|
| 2,714,475 | A * | 8/1955 | Roehrich | 222/501 |
| 2,956,709 | A * | 10/1960 | Nison et al. | 222/129 |
| 5,358,152 | A * | 10/1994 | Banks | 222/442 |
| 6,736,294 | B2 * | 5/2004 | Smith | 222/463 |

FOREIGN PATENT DOCUMENTS

| | | | |
|---|---|---|---|
| EP | 575714 | A1 | 12/1993 |
| WO | 9209736 | A1 | 6/1992 |
| WO | 9209737 | A1 | 6/1992 |

* cited by examiner

*Primary Examiner* — David Walczak
(74) *Attorney, Agent, or Firm* — Norris McLaughlin & Marcus PA

(57) ABSTRACT

A container adapted to contain and dispense a product and method for its use. The container comprises a hollow body, a filling opening, a dispensing opening, a valve and a resiliently deformable means for said valve. The valve may form a leak-tight engagement with the dispensing opening, and is openable by an external force acting on said valve whereby the leak-tight engagement is disengaged, allowing the product to be spread onto a fabric by the valve. The container may be used in a method for pretreating and subsequently laundering pretreated fabrics in an automatic washing machine.

10 Claims, 8 Drawing Sheets

DOSING AND DISPENSING DEVICE FOR LIQUID LAUNDRY DETERGENT

This application claims the priority benefit of U.S. Provisional patent application Ser. No. 61/476,011 filed 15, Apr. 2011.

The present invention relates to a dosing and dispensing device for liquid laundry detergents. The device according to the present invention is particularly adapted to pretreat fabrics with a portion of liquid detergent.

Dispensing devices for liquid detergent, which are to be introduced with the fabrics in the washing machine, are well known in the prior art. It is also known that it is possible to achieve a greater effectiveness in respect of stain removal by pretreating the fabrics without consuming a greater amount of liquid detergent. Pretreatment means that a certain amount of detergent is applied directly onto the dirty parts of said fabrics before they are washed in the machine. In the following these devices are called "pretreatment devices". In the following detergent means a detergent composition for the treatment of fabrics. This detergent composition may comprise washing additives, like beaches, enzymes and/or others known in the art.

Various pretreatment devices for liquid detergent are described in the prior art, for example in WO 92/09736 and WO 92/09737. These devices allow an application of said liquid detergent onto the fabrics before the washing cycle either with predetermined outlets or a removable pretreatment applicator respectively. Another approach is represented by EP-A-575 714. This document describes another pretreatment device for liquid detergent with a fixed applicator in form of a roller ball. This roller ball is able to spread the contained liquid detergent only in a predetermined direction.

The pretreating devices mentioned before allow an even spreading of the contained liquid detergent onto the fabric, i.e. the spread quantity is always the same. This way of even spreading does not consider that different stains need a different amount of liquid detergent during pretreatment. For example, stains can be made of certain constituents which need a more thorough pretreatment to increase its effectiveness. This can be achieved by applying a greater amount of the liquid detergent. A greater quantity is also needed depending on the dimensions of the stain itself. Therefore, we found that the effectiveness of stain removal is increased when a greater amount of pretreating detergent is applied upon the soiled surface of the fabric, since said surface can be pretreated more thoroughly.

It is not possible with the pretreatment devices of the prior art to adjust the amount of liquid detergent on the specific needs. Indeed, the outlets having a fixed aperture or the applicators, being for example a sponge, do not give the possibility to vary the quantity of liquid detergent to be spread on the fabric for a thorough pre-treatment/to control the amount of detergent such that eventual damages to fabrics (i.e. fading, etc.) can be avoided. It is therefore the object of the present invention to provide a device with an adjustable flow of the contained liquid detergent for the pretreatment.

It is an object of the present invention to obviate/mitigate the problems outlined above.

According to a first aspect of the present invention there is provided a container adapted to contain and dispense a product wherein the container may be made from a rigid or flexible material and may be in the form of a bottle or tube, said container comprising a hollow body, a filling opening, a dispensing opening, a valve and a flexible and resilient support means for said valve, wherein said flexible and resilient support means may be made from a material selected from the group consisting of injected resins, elastomeric polymers and a combination thereof and urges said valve against said dispensing opening, achieving a leak-tight engagement between said valve and said dispensing opening, said flexible and resilient support means can be resiliently deformed by an external force acting on said valve whereby said leak-tight engagement between said valve and said dispensing opening is disengaged, allowing said contained product to be spread by said valve, said flexible and resilient support means comprises a housing which fits the container and defines said dispensing opening at one extremity, and said housing comprising, in the region of the opposite extremity to said dispensing opening, at least a resiliently deformable means urging said valve against said dispensing opening to achieve said leak-tight engagement characterized in that when the leak-tight engagement between said valve and said dispensing opening is disengaged a fluid flow pathway is created which has a cross-section of greater than 10% of the width of the dispensing opening.

It has been found that the container of the invention is particularly advantageous in that the amount of detergent dosed from the device and the spreading of the detergent onto the surface being treated is surprisingly beneficial. These benefits include quick/advanced control of discharge of the detergent from the device by the application/removal of pressure applied thereto. Additionally the device of the invention is able to provide a rubbing/scrubbing action as well as the application of pressure.

Generally the fluid pathway is disposed at a side of the valve. This has been found to be particularly important in that if the fluid pathway (especially the channel openings) is not offset from the valve (above all from the top surface thereof) so that the fluid pathway (especially the channel openings) is not to be blocked during dispensing and/or between dispensing operations, e.g. by any residual detergent.

Generally the dispensing opening is located in the bottom part of said device. This allows dosing of the detergent (aided by gravity) onto the surface being treated.

To improve the penetration/spreading of the detergent into the (usually fabric surface) being treated it is preferred that the device (preferably on the flexible portion) comprises a spreading means. Preferably the spreading means is in the form of a ridge. The ridge may be linear or may be curved. Generally a plurality of ridges is present on the device.

Generally the ridge height is about the same as that of a deformed valve. In this way it has been found that the valves may be activate efficiently (i.e. without being closed due to valve "implosion" following an excess of rubbing force.

Generally the ridges are positioned in a different area to that of the valves. This allows a user, after the dosing of the product, to rub the fabric without further dispensing (and/or with a smaller amplitude of the pretreatment movement). Preferably to achieve this aim the valves are positioned away from the centre of the device.

In order to be capable of being used by a consumer generally the device comprises a gripping means. The gripping means preferably comprises the main body of the device, into which the detergent is poured. The main body of the device is preferably shaped so that it is capable of fitting into a hand of a user yet may contain sufficient detergent for a pre-treatment and laundry step. The main body thus has a volume of from 50-200 $cm^3$. The main body may comprise any geometrical shape but is generally based on an ovoid, tapering towards its upper opening (into which the detergent is poured) and also at its lower end (which adjoins onto the flexible portion).

Generally the device is made of elastic plastic material. The main body may comprise PP, PE or PET (both injected or blow moulded). The ridges and the valves may comprise any rubber or elastomer suitable for being welded, melted or glued onto the main body.

Generally the valve is removable affixed to the container. This allows for several advantages to be realised including the replacement of a faulty valve and/or the use of a particular valve in connection with a certain detergent formulation/surface being treated.

According to a second aspect of the present invention there is provided a process for pretreating and washing fabrics in a washing machine with the dosing and dispensing device according to any of the preceding claims, characterized in that it comprises of the following steps: a dose of the total quantity of liquid detergent to be utilized during the pretreatment and washing cycle is introduced into the dosing and dispensing device; pretreatment of the fabrics is executed with a controlled quantity of the liquid detergent dosage contained in said device and dispensed from said device through said cut; the thus pretreated fabrics are placed in the drum of the washing machine together with said dosing and dispensing device and with other non-pretreated fabrics.

Most preferably the device is for a laundry cleaning formulation and for use in dispensing same onto a clothing surface.

Preferably the laundry cleaning formulation comprises a bleach, e.g. in an amount of from 0.001% to 99.99%, preferably 0.001% to 20%, preferably 4% to 18%, e.g. most preferably about 4.5% or 13%, by weight, of bleach. The bleach is preferably peroxide bleach, most preferably hydrogen peroxide. Peroxide sources other than $H_2O_2$ can be used.

Preferably the laundry cleaning formulation comprises a surfactant. Where present the composition comprises from 0.001% to 99.99%, preferably 0.05% to 15%, e.g. about 7%, by weight of surfactant.

The surfactant is, for example, an anionic or nonionic surfactant or mixture thereof (most preferably a nonionic surfactant). The nonionic surfactant is preferably a surfactant having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Examples of other non-ionic surfactants include higher aliphatic primary alcohol containing about twelve to about 16 carbon atoms which are condensed with about three to thirteen moles of ethylene oxide.

Other examples of nonionic surfactants include primary alcohol ethoxylates (available under the Neodol trade name from Shell Co.), such as $C_{11}$ alkanol condensed with 9 moles of ethylene oxide (Neodol 1-9), $C_{12-13}$ alkanol condensed with 6.5 moles ethylene oxide (Neodol 23-6.5), $C_{12-13}$ alkanol with 9 moles of ethylene oxide (Neodol 23-9), C12-15 alkanol condensed with 7 or 3 moles ethylene oxide (Neodol 25-7 or Neodol 25-3), $C_{14-15}$ alkanol condensed with 13 moles ethylene oxide (Neodol 45-13), $C_{9-11}$ linear ethoxylated alcohol, averaging 2.5 moles of ethylene oxide per mole of alcohol (Neodol 91-2.5), and the like.

Other examples of nonionic surfactants suitable for use in the present invention include ethylene oxide condensate products of secondary aliphatic alcohols containing 11 to 18 carbon atoms in a straight or branched chain configuration condensed with 5 to 30 moles of ethylene oxide. Examples of commercially available non-ionic detergents of the foregoing type are $C_{11-15}$ secondary alkanol condensed with either 9 moles of ethylene oxide (Tergitol 15-S-9) or 12 moles of ethylene oxide (Tergitol 15-S-12) marketed by Union Carbide, a subsidiary of Dow Chemical.

Octylphenoxy polyethoxyethanol type nonionic surfactants, for example, Triton X-100, as well as amine oxides can also be used as a nonionic surfactant in the present invention.

Other examples of linear primary alcohol ethoxylates are available under the Tomadol trade name such as, for example, Tomadol 1-7, a $C_{11}$ linear primary alcohol ethoxylate with 7 moles EO; Tomadol 25-7, a $C_{12}$-$C_{15}$ linear primary alcohol ethoxylate with 7 moles EO; Tomadol 45-7, a $C_{14}$-$C_{15}$ linear primary alcohol ethoxylate with 7 moles EO; and Tomadol 91-6, a $C_9$-$C_{11}$ linear alcohol ethoxylate with 6 moles EO.

Other examples of linear primary alcohol ethoxylates are available under the Lutensol trade name such as, for example, Lutensol A3N, a $C_{13-15}$ linear primary alcohol ethoxylate with 3 moles EO; Lutensol LA60, a $C_{13-15}$ linear primary alcohol ethoxylate with 7 moles EO. Also Genapol such as, for example, Genapol LA3, a $C_{13-15}$ linear primary alcohol ethoxylate with 3 moles EO; Genapol LA070, a $C_{13-15}$ linear primary alcohol ethoxylate with 7 moles EO, Tomadol 45-7, a $C_{14}$-$C_{15}$ linear primary alcohol ethoxylate with 7 moles EO; and Tomadol 91-6, a $C_9$-$C_{11}$ linear alcohol ethoxylate with 6 moles EO.

Other nonionic surfactants are amine oxides, alkyl amide oxide surfactants.

Preferred anionic surfactants are frequently provided as alkali metal salts, ammonium salts, amine salts, aminoalcohol salts or magnesium salts. Contemplated as useful are one or more sulfate or sulfonate compounds including: alkyl benzene sulfates, alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Other surfactants which may be used are alkyl naphthalene sulfonates and acyl/oleoyl sarcosinates and mixtures thereof.

The laundry cleaning formulation may comprise various optional ingredients, including enzymes, builders, solvents, dye transfer inhibition agents, dye catchers, preservatives, anti-oxidants, anti-static agents, fragrances, odour absorbing components, optical brighteners, acidifying agents, alkalizing agents, thickeners (e.g. hydroxyethylcellulose and/or xanthan gum).

The container of the invention is further described by reference to the following Figures in which:

FIG. 1 is a plan view of a device in accordance with the invention;

FIG. 2 provides several cross-sectional views of a portion of a device in accordance with the invention;

FIG. 3 provides an exploded view of the portion of the device depicted on FIG. 2.

Figure 7:
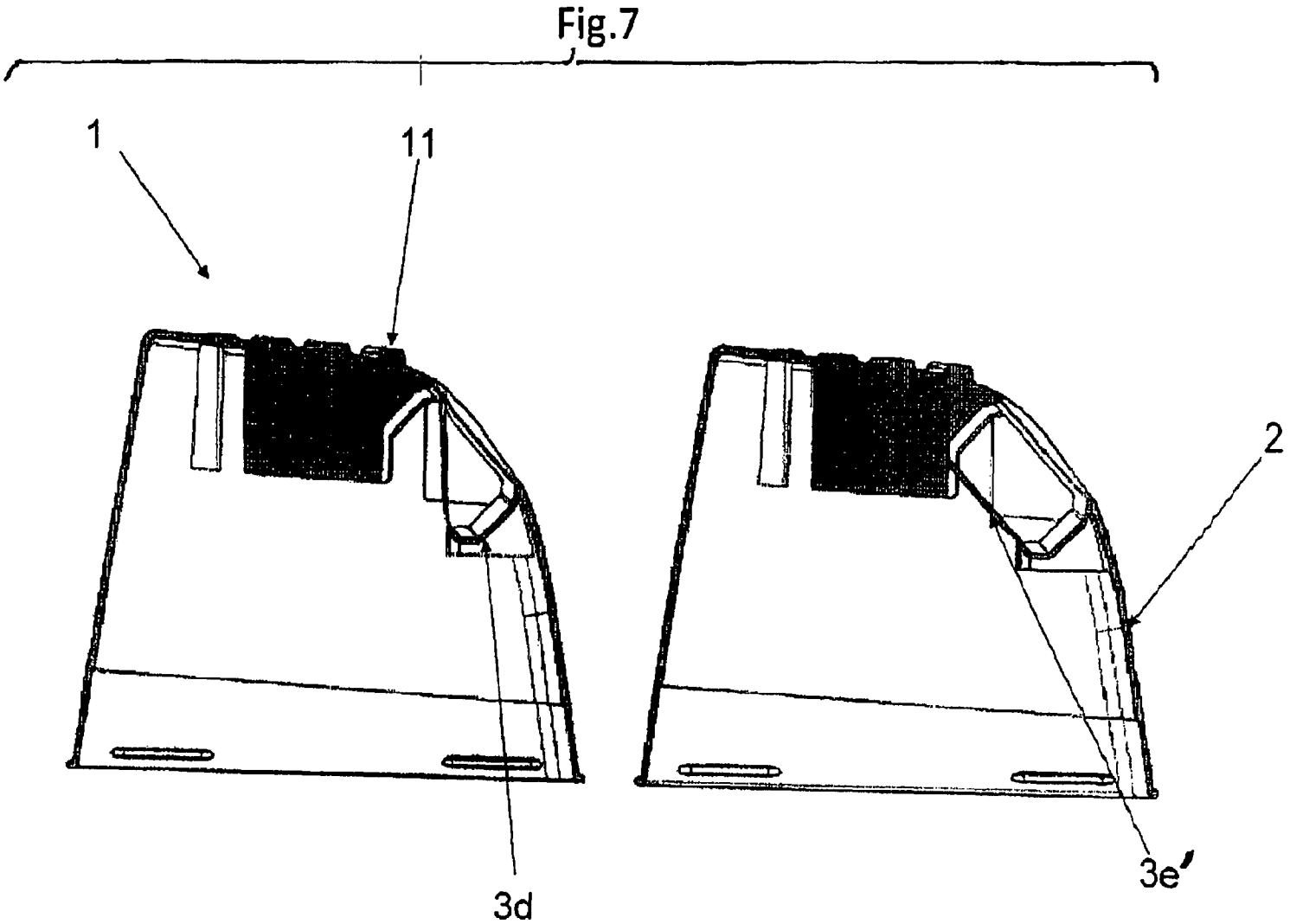
FIG. 7 provides several cross-sectional views of a third embodiment of a device in accordance with the invention.
Figure 8:
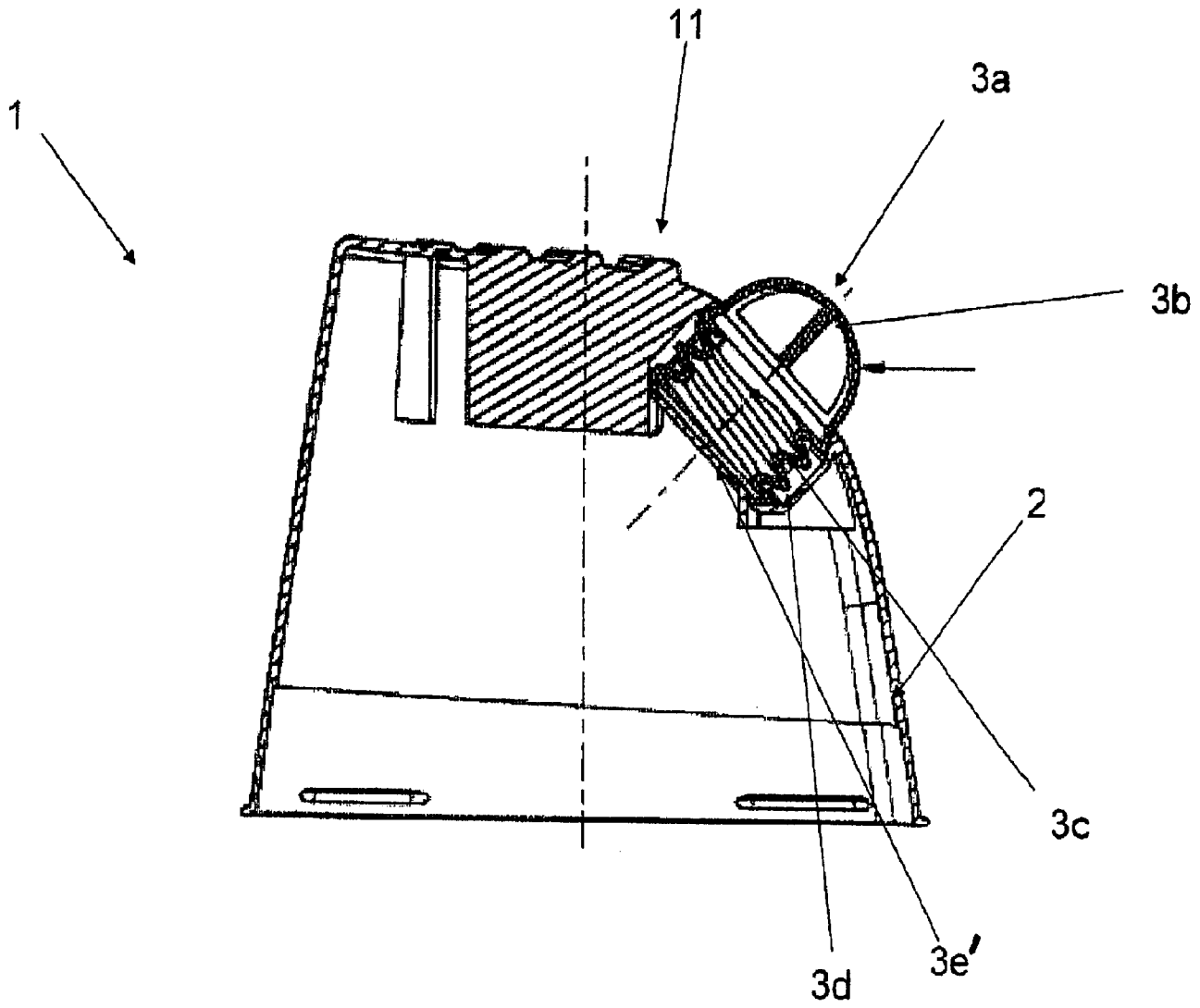

FIG. 8 provides a further cross sectional view of the device depicted on FIG. 7.

Figure 1:
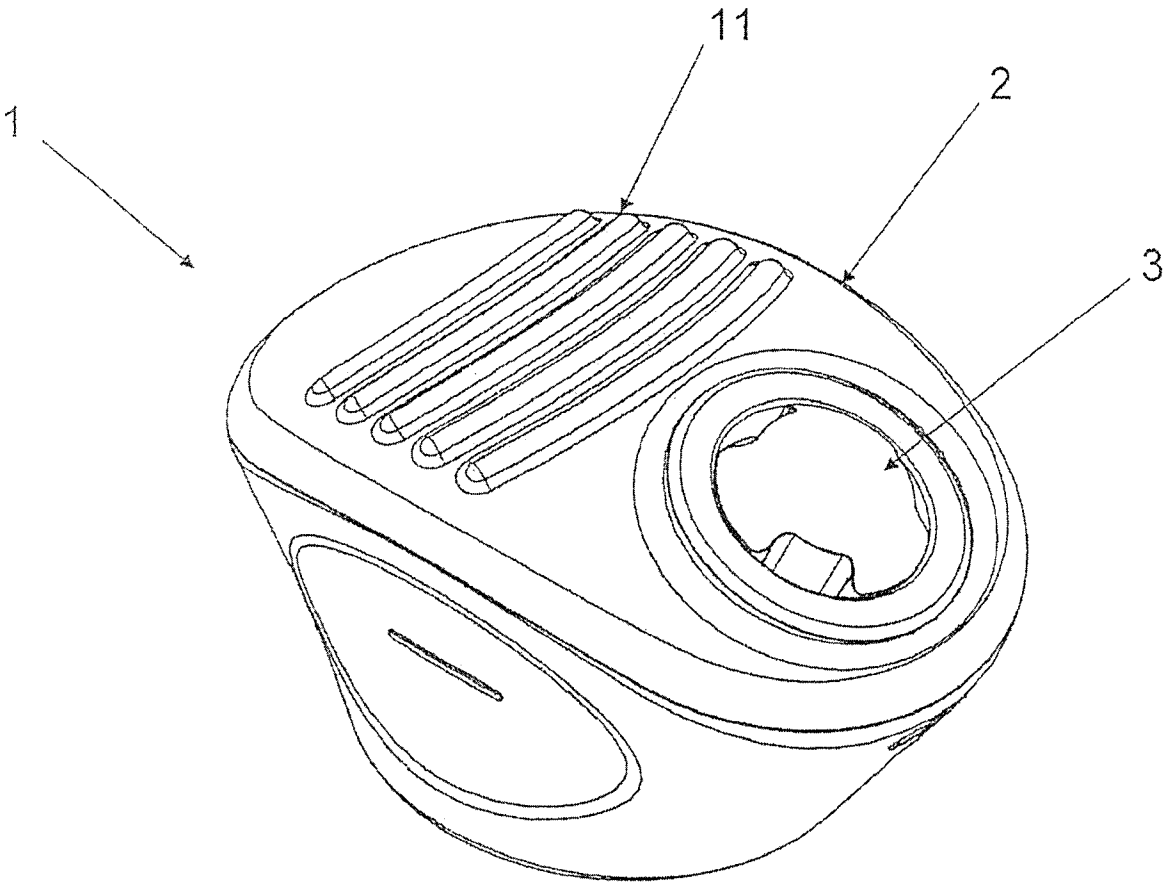
Figure 2:
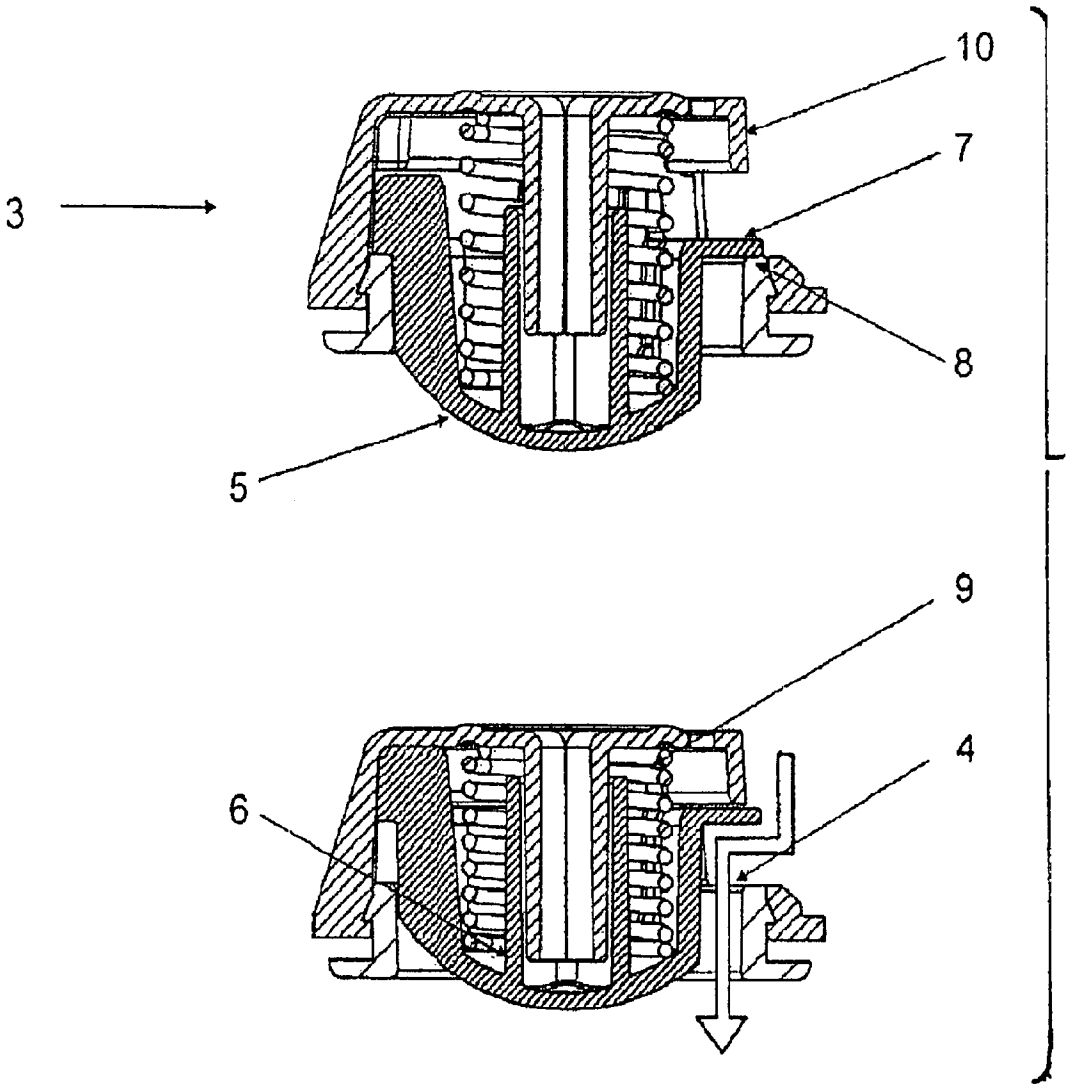
Figure 3:
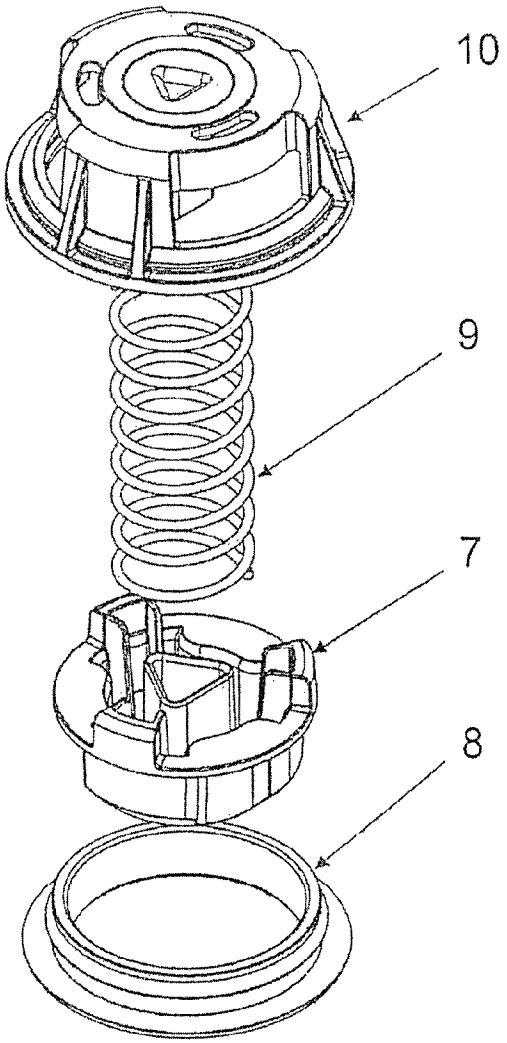

From FIGS. 1 to 3 the first embodiment of a device 1 can be seen. Device 1 comprises a main body section 2 in the form of a modified portion of a sphere/spheroid. The main body 2 is able to act as a handle for use by a consumer. The main body has an opening (not shown) for introduction of detergent into the device and release of detergent in a (laundry) washing cycle.

The main body 2 has a valve 3 disposed on its lower surface.

The valve 3 has a fluid pathway 4 that may be opened by the application of pressure (contact and/or translational) on a surface.

Application of pressure on a surface onto a terminal shaped dome 5 of the valve stem 6 of the valve 3, causes movement of the valve stem 6 and in turn an adjoined sealing portion 7 of the valve stem 6 away from a valve seat 8. This movement is performed against a biasing force applied by a deformable spring 9 working against a portion of the valve housing 10. When the sealing portion 7 is moved away from the valve seat 8 the fluid pathway 4 is created. In doing so fluid can flow from the main body 2 of the device 1 through the valve 3.

The body portion 2 also comprises a plurality of curved spreading ridges 11 on its lower surface.

In use a dose of the total quantity of liquid detergent to be utilized during the pretreatment and washing cycle is introduced into the device 1. Pretreatment of fabrics is executed with a controlled quantity of the liquid detergent dosage contained in said device 1 being dispensed from said device 1 through said valve 3. This is achieved by pressing and rubbing the device 1 on the fabric surface to be treated, thus causing release of detergent and spreading of same (aided by the ridges 11) on the surface being treated. The thus pretreated fabrics are placed in the drum of the washing machine together with said dosing and dispensing device 1 and with other non-pretreated fabrics. A washing cycle may then be operated.

Figure 4:
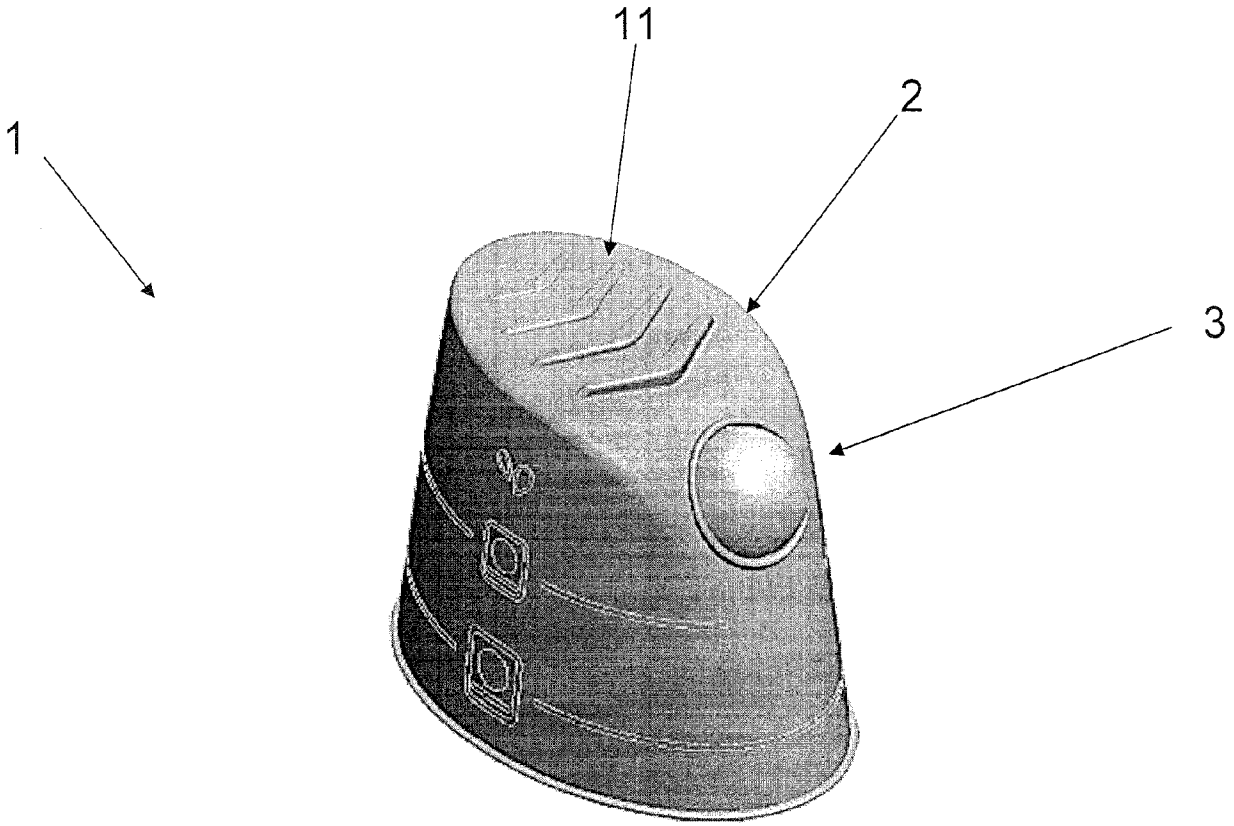
FIG. 4 is a plan view of a second embodiment of a device in accordance with the invention.
Figure 5:
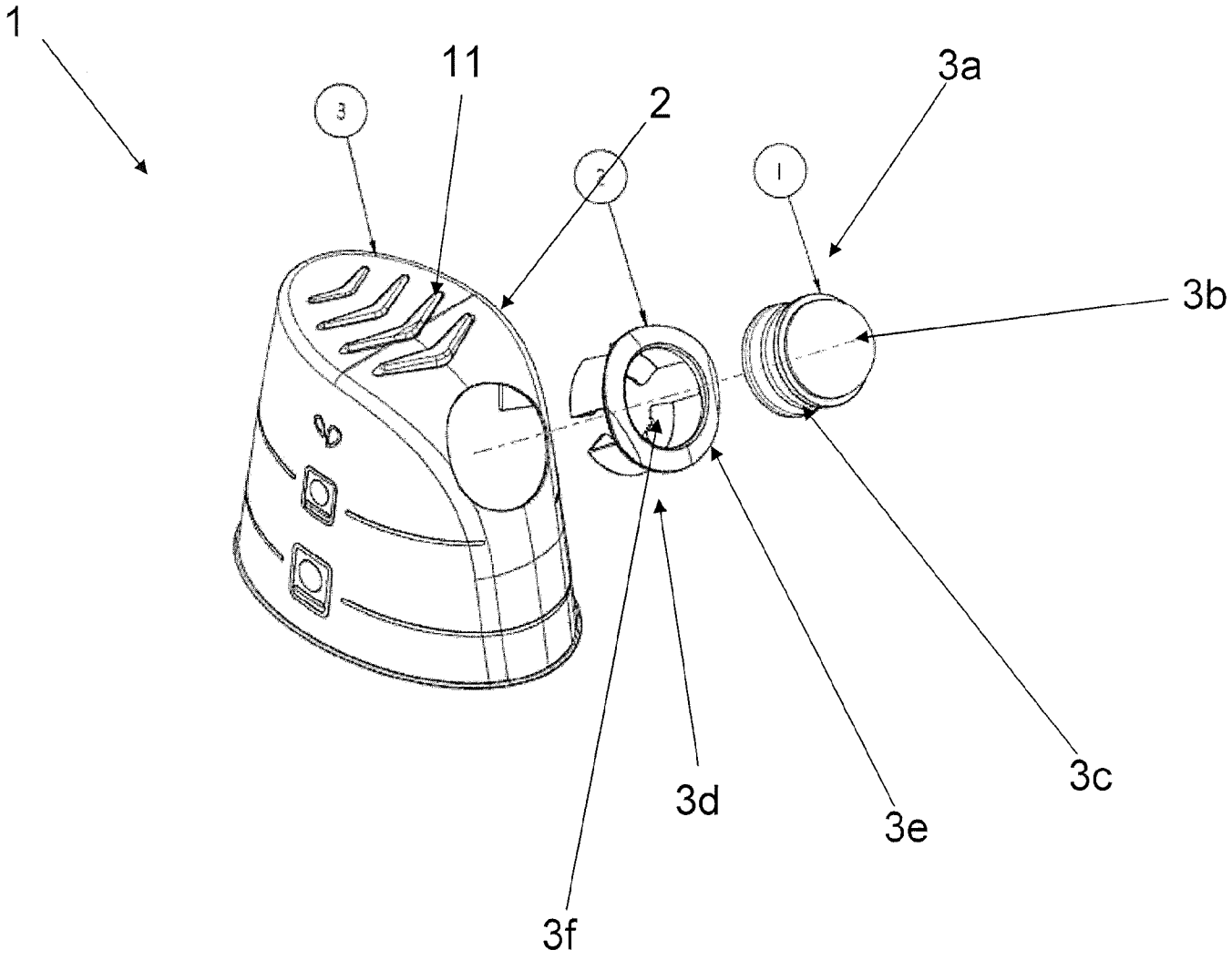
FIG. 5 is a plan view of an exploded second embodiment of a device in accordance with the invention.
Figure 6:
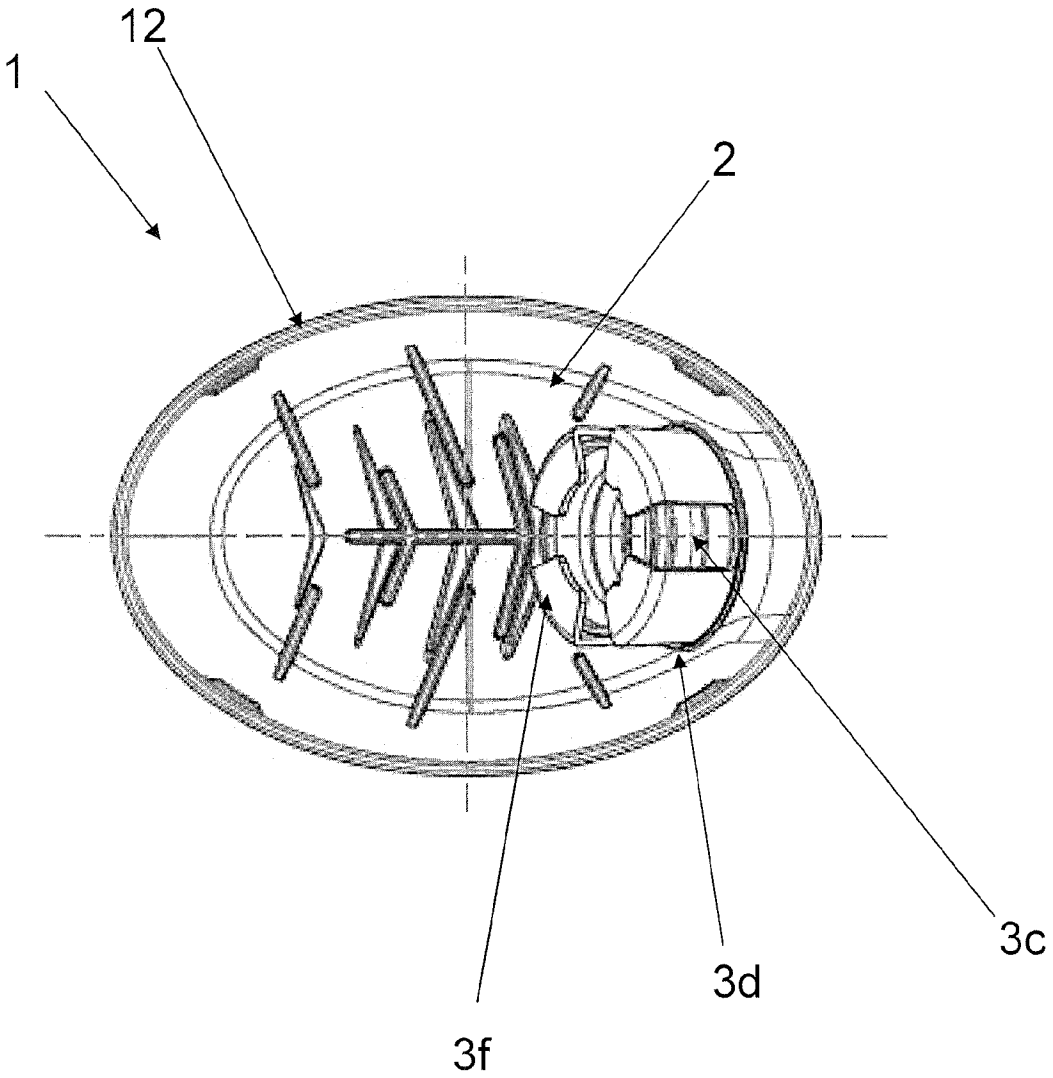
FIG. 6 is an underside view of a second embodiment of a device in accordance with the invention.

From FIGS. 4 to 6 the second embodiment of a device 1 can be seen. Device 1 comprises a main body section 2 in the form of a modified portion of a sphere/spheroid. The main body 2 is able to act as a handle for use by a consumer. The main body has an opening 12 for introduction of detergent into the device and release of detergent in a (laundry) washing cycle.

The main body 2 has a valve 3 disposed on its lower surface.

The valve comprises a compressible member 3*a* which has an outwardly facing/terminally domed section 3*b* and a compressible cylindrical section 3*c*. The compressible cylindrical section 3*c* comprises a concertinaed cylinder. The compressible member 3*a* comprises a resilient material such as silicone rubber.

The valve 3 comprises a housing 3*d* in which the compressible member 3*a* sits. The housing 3*d* is in the form of a cylinder having one or more apertures in its cylindrical sides. The housing comprises two termini 3*e*, 3*f* in the form of flanges. A first flange 3*e* abuts against the main body 2 of the device 1 and secures the valve 3 thereto as well as providing a seat for the compressible member 3*a*. A second flange 3*f* provides a seat which supports the compressible cylindrical section 3*c* of the compressible member 3*a*.

As will be appreciated due to the way that the first flange 3*e* abuts against the main body 2 of the device 1 the connection of the flange 3*e* and the main body 2 may be disrupted. Namely the flange 3*e* (and thus the whole valve 3) may be disconnected form the device 1.

In its inactivated status the terminal domed section 3*b* of the compressible member 3*a* is urged against the first flange 3*e*. Thus the valve 3 is closed.

Application of pressure on a surface causes movement of the terminal shaped dome 3*b* away from engagement with the first flange 3*e*. This movement is performed against a biasing force applied by the compressible cylindrical section 3*c* working against the second flange 3*f*. When the terminal shaped dome 3*b* is moved away from the first flange 3*e* a fluid pathway 4 is created. In doing so fluid can flow from the main body 2 of the device 1 through the valve 3 (movement occurs through the apertures of the valve housing 3*d*).

The body portion 2 also comprises a plurality of curved spreading ridges 11 on its lower surface.

In use a dose of the total quantity of liquid detergent to be utilized during the pretreatment and washing cycle is introduced into the device 1. Pretreatment of fabrics is executed with a controlled quantity of the liquid detergent dosage contained in said device 1 being dispensed from said device 1 through said valve 3. This is achieved by pressing and rubbing the device 1 on the fabric surface to be treated, thus causing release of detergent and spreading of same (aided by the ridges 11) on the surface being treated. The thus pretreated fabrics are placed in the drum of the washing machine together with said dosing and dispensing device 1 and with other non-pretreated fabrics. A washing cycle may then be operated.

From FIGS. 7 and 8 the third embodiment of a device 1 can be seen. Device 1 comprises a main body section 2 in the form of a modified portion of a sphere/spheroid. The main body 2 is able to act as a handle for use by a consumer. The main body has an opening 12 for introduction of detergent into the device and release of detergent in a (laundry) washing cycle.

The main body 2 has a valve 3 disposed on its lower surface.

The valve comprises a compressible member 3*a* which has an outwardly facing/terminally domed section 3*b* and a compressible cylindrical section 3*c*. The compressible cylindrical section 3*c* comprises a concertinaed cylinder. The compressible member 3*a* comprises a resilient material such as silicone rubber.

The valve 3 comprises a housing 3*d* (integrated into the main body 2) in which the compressible member 3*a* sits. The housing 3*d* is in the form of a cylindrical cage having one or more apertures in its cylindrical sides. The housing comprises a terminus 3*e*' in the form of a flange.

The flange 3*e*' is movable between a first and a second position. It is hingedly joined at one end to a side of the housing 3*d* and has a free end. In its first position the flange extends into the volume of the housing 3*d*. When the compressible member 3*a* is inserted into the housing 3*d* it pushes the flange 3*e*' downwards, through an arc until the free end abuts against a potion of the housing 3*d*, locking in place. In this way the flange 3*e*' and the housing 3*d* provide support for the compressible member 3*a*.

This arrangement has been found to be beneficial for several reasons. Firstly it allows a much more simplistic manufacturing/moulding technique. This is particularly beneficial in that the number of moulded parts is reduced with much fewer components. This advantage may be realised because of the movement capability of the flange 3*e*'. Additionally in use this arrangement aids to ensure that the compressible member 3*a* may only move along one axis ensuring more effective release of detergent and sealing after use. This is at least partly achieved by a reduction in flexing of the housing 3*d* in use.

In its inactivated status the terminal domed section 3*b* of the compressible member 3*a* is urged against the main body 2. Thus the valve 3 is closed.

Application of pressure on a surface causes movement of the terminal shaped dome 3*b* away from engagement with the main body 2. This movement is performed against a biasing force applied by the compressible cylindrical section 3*c* working against the flange 3*e*'. When the terminal shaped dome 3*b* is moved away from the first flange 3*e*' a fluid pathway 4 is created. In doing so fluid can flow from the main body 2 of the device l through the valve 3 (movement occurs through the apertures of the valve housing 3*d*).

The body portion 2 also comprises a plurality of curved spreading ridges 11 on its lower surface.

In use a dose of the total quantity of liquid detergent to be utilized during the pretreatment and washing cycle is introduced into the device 1. Pretreatment of fabrics is executed with a controlled quantity of the liquid detergent dosage contained in said device 1 being dispensed from said device 1 through said valve 3. This is achieved by pressing and rubbing the device 1 on the fabric surface to be treated, thus causing release of detergent and spreading of same (aided by the ridges 11) on the surface being treated. The thus pretreated fabrics are placed in the drum of the washing machine together with said dosing and dispensing device 1 and with other non-pretreated fabrics. A washing cycle may then be operated.

The invention claimed is:

1. A method of dispensing a detergent, the method comprising the steps of:

providing a container adapted to contain and dispense a detergent, said container comprising a hollow body, a filling opening, a dispensing opening, a moveable valve and a resiliently deformable means for said valve, wherein in a first position the moveable valve is urged against the dispensing opening by the said resiliently deformable means achieving a leak-tight engagement between said valve and said dispensing opening, wherein in a second position the valve and the dispensing opening are disengaged when the resiliently deformable means are deformed by an external force acting on said valve creating a fluid flow pathway which has a cross section of great than 10% of the width of the dispensing opening through which fluid flow pathway the detergent may be dispensed from the container;

providing a liquid detergent to the said container via the filling opening and;

subsequently dispensing a portion of the liquid detergent present within the said container via the dispensing opening to a soiled area of a fabric, and, thereafter inserting the container and the fabric into an automatic washing machine for an automatic wash cycle.

2. A method according to claim 1 wherein said flow pathway is disposed at a side of the valve.

3. A method according to claim 1 wherein said resiliently deformable means comprises a spring located under said valve.

4. A method according to claim 1 wherein said resiliently deformable means is made of a material selected from the group consisting of: injected resins, elastomeric polymers and a combination thereof.

5. A method according to claim 1 wherein the container further comprises a spreading/scrubbing means.

6. A method according to claim 5, wherein the spreading/scrubbing means is in the form of a ridge, which is linear or curved.

7. A method according to claim 1 wherein said container is made of a rigid or flexible material.

8. A method according to claim 1 wherein said container is in the form of a bottle or a tube.

9. A method according to claim 1 wherein said container is a dosing and/or dispensing device.

10. A method according to claim 1 wherein said valve has a terminal shaped dome.

* * * * *